US006644941B1

(12) United States Patent
Able et al.

(10) Patent No.: US 6,644,941 B1
(45) Date of Patent: Nov. 11, 2003

(54) APPARATUS AND METHOD FOR REDUCING ICE FORMATION IN GAS-DRIVEN MOTORS

(75) Inventors: Stephen D. Able, Bryan, OH (US); G. Keith Hancock, Bryan, OH (US); Lloyd I. Towne, Bryan, OH (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 1 day.

(21) Appl. No.: 10/125,008

(22) Filed: Apr. 18, 2002

(51) Int. Cl.[7] ..... F04B 17/00

(52) U.S. Cl. ..... 417/393; 417/395; 71/313; 91/329

(58) Field of Search ..... 417/393, 395, 417/53; 91/313, 329

(56) References Cited

U.S. PATENT DOCUMENTS

| | | | | | |
|---|---|---|---|---|---|
| 2,944,528 | A | | 7/1960 | Phinney | 121/46.5 |
| 3,635,125 | A | | 1/1972 | Rosen et al. | 91/55 |
| 4,406,596 | A | | 9/1983 | Budde | 417/393 |
| 4,496,294 | A | | 1/1985 | Frikker | 417/393 |
| 4,566,867 | A | * | 1/1986 | Bazan et al. | 417/393 |
| 4,708,601 | A | * | 11/1987 | Bazan et al. | 417/393 |
| 4,854,832 | A | | 8/1989 | Gardner et al. | 417/393 |
| 4,921,408 | A | | 5/1990 | Kvinge et al. | 417/368 |
| 4,978,283 | A | | 12/1990 | Vonalt | 417/511 |
| 5,161,450 | A | | 11/1992 | Ishikawa | 91/55 |
| 5,277,099 | A | | 1/1994 | Powers | 91/350 |
| 5,366,353 | A | | 11/1994 | Hand | 417/375 |
| 5,368,452 | A | | 11/1994 | Johnson et al. | 417/395 |
| 5,551,847 | A | * | 9/1996 | Gardner et al. | 417/393 |
| 5,584,666 | A | | 12/1996 | Kozumplik, Jr. et al. | 417/46 |
| 5,607,290 | A | | 3/1997 | Duncan | 417/393 |
| 5,616,005 | A | * | 4/1997 | Whitehead | 417/46 |
| 5,649,813 | A | * | 7/1997 | Able et al. | 417/387 |
| 5,957,670 | A | | 9/1999 | Duncan et al. | 417/395 |
| 6,152,705 | A | | 11/2000 | Kennedy et al. | 417/395 |
| 6,190,136 | B1 | | 2/2001 | Meloche et al. | 417/63 |
| 6,299,413 | B1 | | 10/2001 | Stahlman et al. | 417/53 |

OTHER PUBLICATIONS

ARO Brochure 8730–P, Fluid Handling Text, Lesson 3: Fluid Handling Technology, © 1987 The Aro Corporation, 32 Pages (No Month of Publication Given).

Pumping Technology Article, Reciprocating Air Motor Operated Pumps: Operating Principles, Steve Able, ARO Fluid Products Div., Ingersoll–Rand, Inc., Apr./May 1999, 8 Pages.

Air Operated Diaphragm Pumps: Performance and Operating Principles, Jan. 10, 1997, Steve Able, ARO Fluid Products Div. Ingersoll–Rand, 24 Pages.

Thermodynamics An Engineering Approach, Third Edition, Dr. Yunus A. Cengel, University of Nevada, Reno; Dr. Michael A. Boles, North Carolina State University; Cover Page, pp. 224 and 225, (undated).

* cited by examiner

*Primary Examiner*—Charles G. Freay
*Assistant Examiner*—Michael K. Gray
(74) *Attorney, Agent, or Firm*—Michael Best & Friedrich LLP

(57) ABSTRACT

A method for reducing ice formation in a gas-driven motor and a reduced-icing, gas-driven motor are provided, the motor having a housing with a first pressure chamber and a second pressure chamber. At least one partition is disposed in the housing and is reciprocally moveable therein responsive to a motive gas being alternately provided to and exhausted from the first and second pressure chambers. A motive gas conduit is disposed between and connects the pressure chambers such that, upon providing the first pressure chamber with motive gas and exhausting the second pressure chamber of motive gas, a portion of the motive gas is permitted to pass from the first pressure chamber to the second pressure chamber through the motive gas conduit. Also provided are a reduced-icing diaphragm and piston pumps having the reduced-icing, gas-driven motor according to the present invention.

20 Claims, 5 Drawing Sheets

APPARATUS AND METHOD FOR REDUCING ICE FORMATION IN GAS-DRIVEN MOTORS

FIELD OF THE INVENTION

This invention relates generally to motors driven by a motive gas and more particularly to prevention of icing in the exhaust ports and passageways of motors for pumps of the piston or diaphragm type and the like.

BACKGROUND OF THE INVENTION

Motors that are driven by a motive gas, such as air, often will slow down sputter or stop due to ice formation in the motor, including the exhaust valving and the exhaust ports, during operation of the motor. In some instances elastomers in the motor can be damaged by ice formations and the movement of adjacent parts inside the motor. Ice formation not only inhibits proper operation of a pump having a motor but can also be unsightly because ice can form on the outside of the housing. It is therefore desirable to minimize or eliminate the formation of ice during motor operation.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

According to the present invention, a method for reducing ice formation in a gas-driven motor and a reduced-icing, gas-driven motor are provided, the motor having a housing with a first pressure chamber and a second pressure chamber. At least one partition is disposed in the housing and is reciprocally moveable therein responsive to a motive gas being alternately provided to and exhausted from the first and second pressure chambers. A motive gas conduit is disposed between and connects the pressure chambers such that, upon providing the first pressure chamber with motive gas and exhausting the second pressure chamber of motive gas, a portion of the motive gas is permitted to pass from the first pressure chamber to the second pressure chamber through the motive gas conduit. Also provided are reduced-icing diaphragm and piston pumps having the reduced-icing, gas-driven motor according to the present invention.

The foregoing and other aspects will become apparent from the following detailed description of the invention when considered in conjunction with accompanying drawing figures.

BRIEF DESCRIPTION OF THE DRAWING FIGURES

Figure 1:
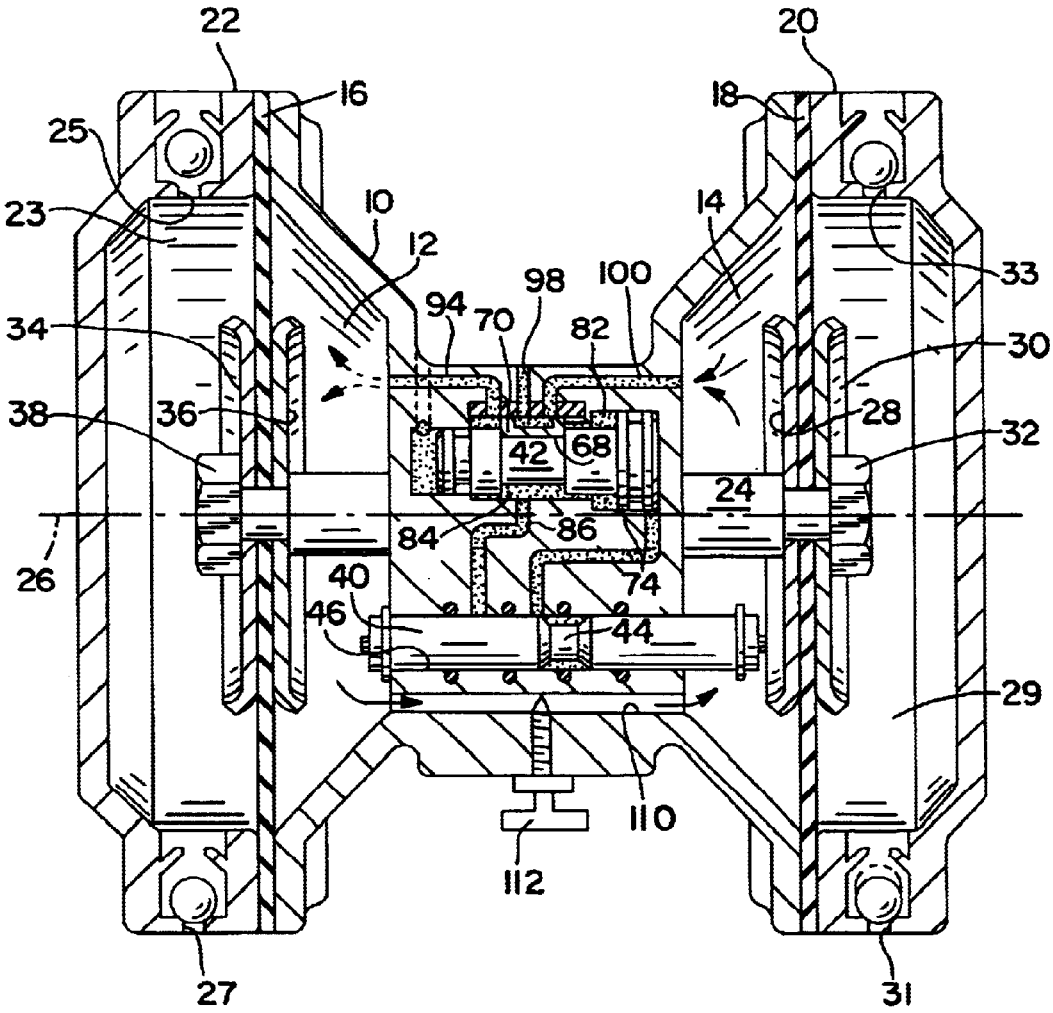
FIG. 1 is a cross-sectional view of a double diaphragm pump having a reduced-icing, gas-driven motor according to one embodiment the present invention.

These and many other objects and advantages of the present invention will be readily apparent to one skilled in the art from the claims and from the following detailed description when read in conjunction with the appended drawings.

DETAILED DESCRIPTION OF THE INVENTION

The invention is best understood by reference to the accompanying drawings in which like reference numbers refer to like parts. It is emphasized that, according to common practice, the various dimensions of the component parts as shown in the drawings are not to scale and have been enlarged for clarity.

Compressed gases, such as air, that are used to drive motors typically have some degree of water vapor that can freeze to form ice due when exposed to the cold air temperatures caused when the compressed gas is allowed to expand, as is known in the art. According to the present invention, it has been found that low temperatures generated in the working pressure chamber (i.e., a chamber adjacent to a piston or diaphragm) can cause the motive gas that is being exhausted to freeze anywhere along the flow path from the pressure chamber, through the exhaust valving, and to the exhaust port or chamber. The ice often forms in bend areas of the flow path of the main exhaust valve, i.e., the main throttle point, where the temperatures are coldest.

According to the present invention, icing in motors that are driven by a motive gas such as air is reduced by providing a small amount of the motive gas from a pressure chamber that is filling to a pressure chamber that is exhausting. The air is preferably supplied through a fixed orifice, a valve, or other variable orifice, that connects the pressure chambers but most preferably restricts the flow until an initial high mass flow of air has exhausted the exhausting chamber as discussed in greater detail below.

Turning to the figures, shown in FIGS. 1–4 are double diaphragm pumps having air motors according to embodiments the present invention. The diaphragm pumps shown are similar to those known in the art with the addition of a connection between the air chambers according to the present invention as described further in detail below. The background description and operation of the conventional features of these pumps are shown and described in U.S. Pat. No. 4,854,832, the disclosure of which is incorporated herein by reference and in summary may be considered as follows:

The air motors of the double diaphragm pumps shown in FIGS. 1–4 have a mechanical shift, pneumatic assist pilot valve construction. The pump includes a main housing 10 that defines first and second opposed axially spaced pressure chambers 12 and 14 which are substantially identical in size, shape and volume. The chambers 12 and 14 are generally conical in shape. Associated with each chamber 12 and 14 is a flexible diaphragm 16 and 18, respectively. The diaphragms 16 and 18 are moveable partitions that are generally circular in shape and are held in position in sealing relationship with the housing 10 by an associated enclosure member 20 and 22, respectively. Thus, as depicted on the right hand side of FIG. 1, housing 10, diaphragm 18 and member 20 define a housing cavity having a pressure chamber 14 and a pump chamber 29. Similarly, as depicted on the left side of FIG. 1, housing 10, diaphragm 16 and member 22 define a housing cavity having a pressure chamber 12 and a pump chamber 23.

Each of the diaphragms 16 and 18 is fashioned from an elastomeric material as is known to those skilled in the art. The diaphragms 16 and 18 are connected mechanically by means of a connecting rod 24 that extends axially along an axis 26 through the midpoint of each of the diaphragms 16 and 18. The connecting rod 24 is attached to the diaphragm 18 by means of opposed plates 28 and 30 on opposite sides thereof retained in position by a bolt 32 in connecting rod 24. With respect to diaphragm 16, plates 34 and 36 are retained by a bolt 38 threaded into the connecting rod 24. Thus, the diaphragms 16 and 18 will move axially in unison as the pump operates.

During operation the chamber 12 will initially be pressurized and the chamber 14 will be connected with an exhaust 98. This will cause the diaphragm 16 to move to the left in FIG. 1 thereby compressing a fluid to be pumped within a pump chamber 23 thereby forcing that fluid outwardly through an outlet check valve 25. An inlet check valve 27 at the opposite end of chamber 23 is closed by this pumping action. Simultaneously as the diaphragm 16 moves to the left in FIG. 1, the diaphragm 18 will also move to the left. Pressurized fluid from the chamber 14 will exhaust. At that same time the fluid being pumped will enter chamber 29 through an inlet check valve 31. An outlet check valve 33 will be closed during this operation.

Movement of the connecting rod 24 in the reverse direction or to the right of FIG. 1 will reverse the pumping and filling operations of the pump chambers 23 and 29. In any event, flow is effected out of the pump through the outlet check valves 25 and 33. Fluid flow into the pump is effected through the inlet check valves 27 and 31.

The pilot construction includes an axially slidable mechanical pilot member or shift rod 40 and a pneumatically operated actuator 42. Mechanical pilot member 40, is a generally cylindrical rod that projects through the housing 10 into the chambers 12 and 14. The member 40 includes a reduced diameter, annular groove 44 at approximately the midpoint from the ends of the member 40. The member 40 slides in a cylindrical passage 46 defined through the housing 10.

The actuator 42 is a generally cylindrical valve member disposed in a chamber 84 and having a series of different diameters so as to provide for actuation in response to pressure differential. Actuator 42 also includes an expanded diameter head 74 portion disposed in a chamber 84 and an annular groove 68 that receives a sliding D-valve 70. A fluid pressure port 86 provides fluid pressure to operate the pump from a pressure fluid source (not shown) that provides a motive gas, typically air.

In operation, air enters through port 86 and pressurizes chamber 84 as well as a part of chamber 82. As described in the referenced '832 patent, the air is then either distributed to chamber 12 or chamber 14 depending on the position of the actuator 42, the position of actuator 42 being further determined by the position of shift rod member 40, as more thoroughly described in the above referenced patent through ports 94 or 100. The unpressurized chamber exhausts through the alternative of passageway 94 or 100 as controlled by the D-valve 70. The exhaust air exits the pump through passageway 98. By alternately pressurizing and exhausting chambers 12 and 14 through actuator 42, continuous pumping is achieved.

According to the present invention, a motive gas conduit 110 is disposed between and connects the pressure chambers 12 and 14 such that, during the alternating pressurization and exhaust of the chambers, a portion of the gas filling the pressure chamber being pressurized is permitted to pass through the motive gas conduit to the pressure chamber being exhausted. In this fashion, by bleeding air to the exhausting chamber, the air temperature is raised to reduce icing in the exhausting chamber and the associated exhaust passageways.

In one embodiment of the present invention, a variable restriction is provided in the motive gas conduit to control the amount of bleed air that passes to the exhausting chamber. As shown in FIG. 1, the variable restriction may be provided in the form of a threaded needle valve 112 that can be manually be turned to open or close the motive gas conduit. In practice, when using such a valve, the amount of air that is to be bled to the exhausting chamber may be empirically determined by running the pump and increasing the rate of bleed air to the exhaust chamber until a decreased amount of icing is observed upon visually inspecting the motor. Typically approximately 2–3 percent of the air flow that is being supplied to the chamber being pressurized is bled off to the chamber being exhausted. Although a greater amount of percentage of air may be supplied to the exhausting chamber to provide an additional warming effect, it is to be understood that an attendant loss of power is associated with the air that is diverted from the chamber that is being filled. Thus, the least amount of air that achieves the desired reduction in icing is most preferred.

Figure 2:
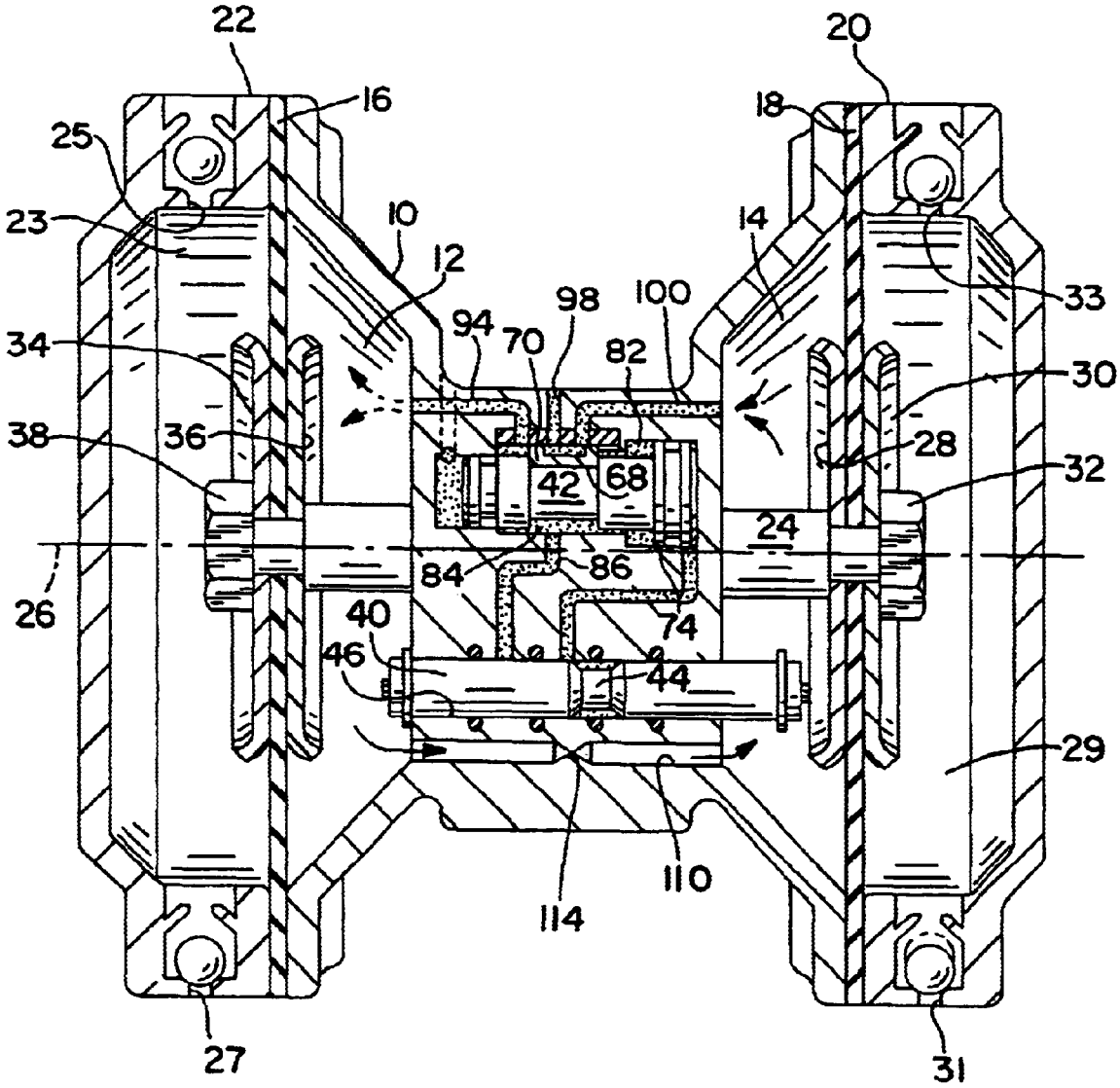
FIG. 2 is a cross-sectional view of a double diaphragm pump having a reduced-icing, gas-driven motor according to another embodiment the present invention.

Alternative variable restriction are shown schematically in FIG. 2 in the form of a solenoid or a pneumatic valve 114 that may be used to control the amount of bleed air that flows through motive gas conduit 110. Preferably, these valves may be use in conjunction with thermocouples attached to the pump (not shown) that monitor and provide the operating temperatures of the motor to a computer controller (not shown) that can, in turn, automatically control valve 114 to increase or decrease the amount of bleed air as needed.

Figure 3:
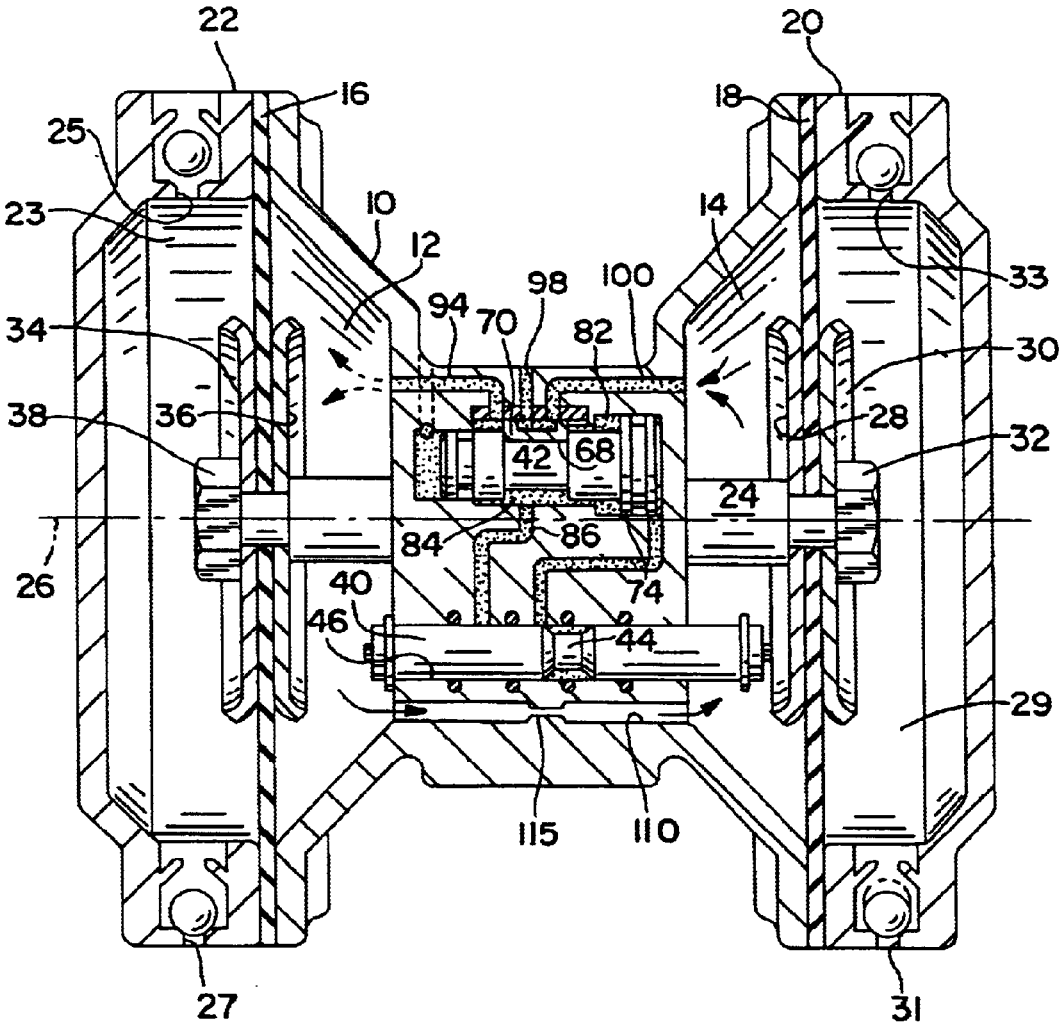
FIG. 3 is a cross-sectional view of a double diaphragm pump having a reduced-icing, gas-driven motor according to another embodiment the present invention.

In yet another embodiment shown in FIG. 3, a fixed restriction 115 in the motive gas conduit that, preferably, is a portion of the motive gas conduit having a decreased cross-section.

Figure 4:
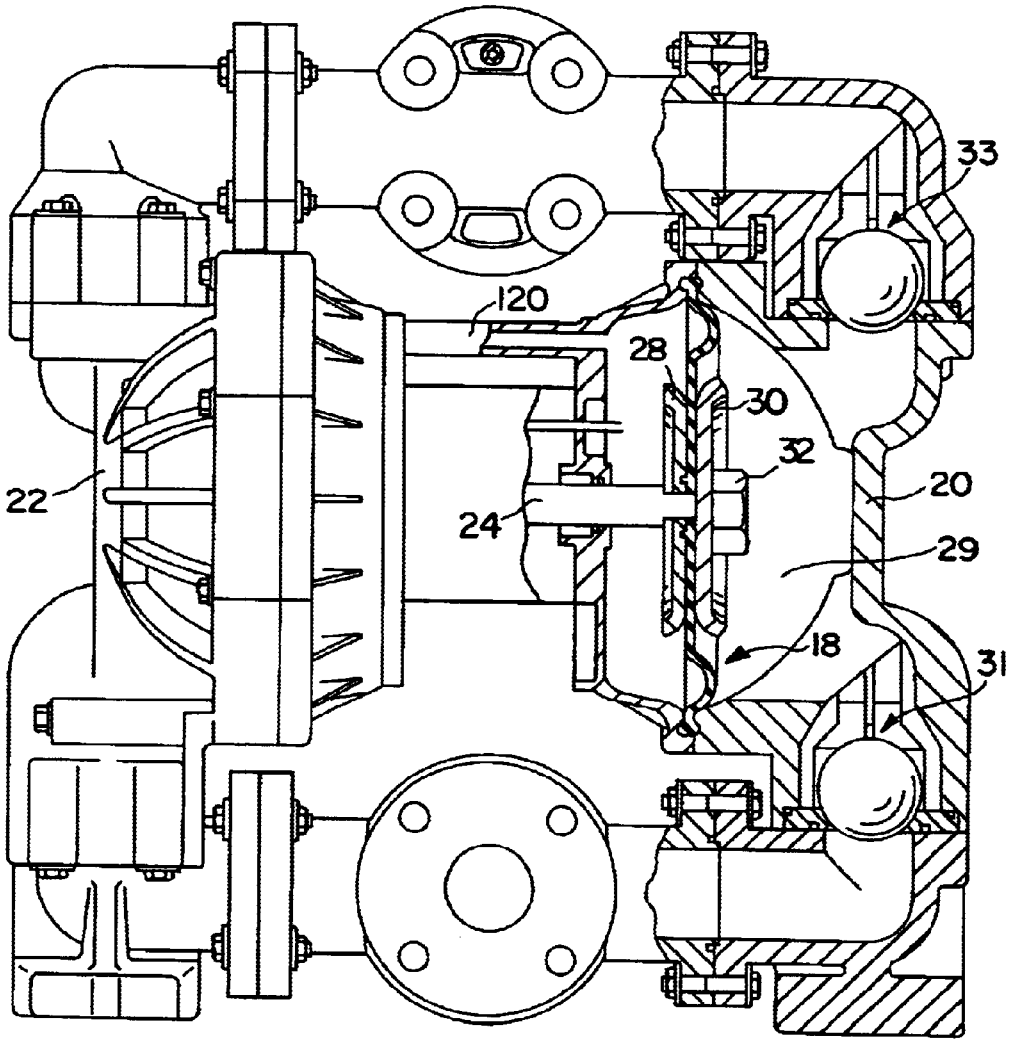
FIG. 4 is a cross-sectional view of a double diaphragm pump having a reduced-icing, gas-driven motor according to another embodiment the present invention.

As shown in FIGS. 1–3, the motive gas conduit connecting the first and the second pressure chambers may be provided as a bore located in the housing as shown. Alternatively, as shown in FIG. 4, the motive gas conduit may be provided as a tubular member 120 that connects the portions of the housing defining the pressure chambers. This latter embodiment is particularly useful in the cases of retrofitting existing motors having a housing in which the pressure chambers are separated as shown.

Figure 7:
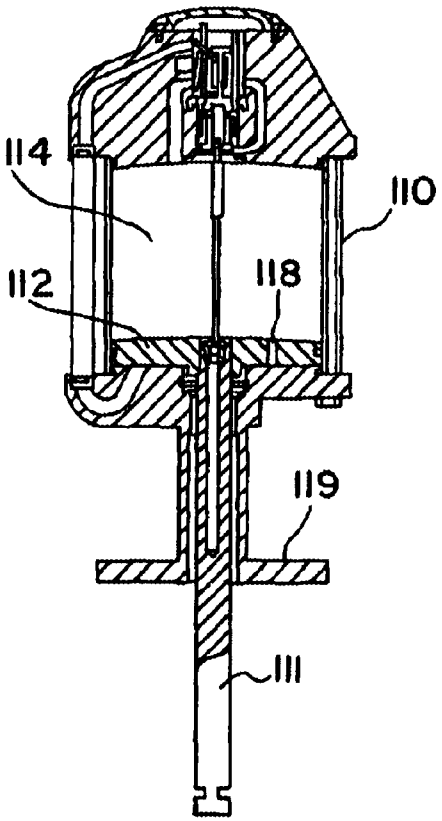
FIGS. 5–7 are sequential, cross-sectional views of a reciprocating piston pump having a reduced-icing, gas-driven motor according to another embodiment the present invention.
Figure 6:
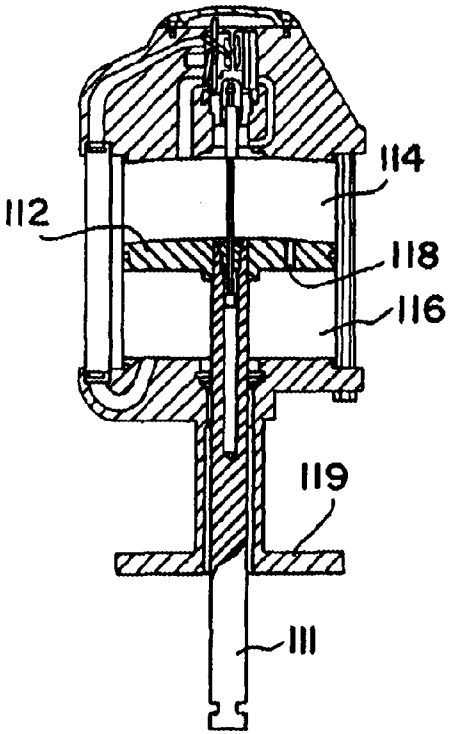
Figure 5:
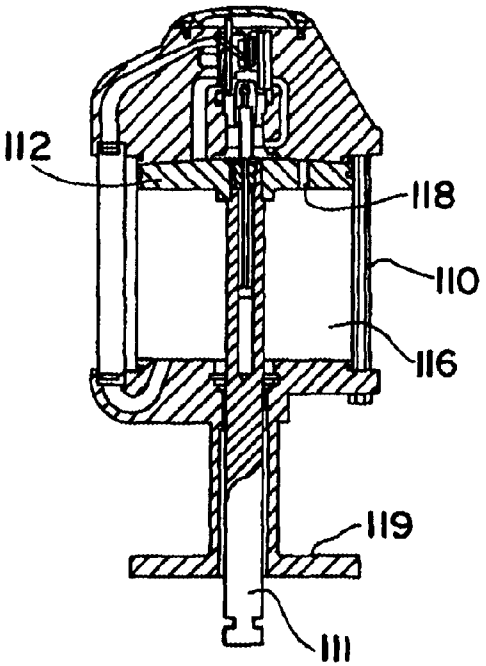

Although shown and described above with respect to motors used in the context of double diaphragm pumps, the present invention is not limited to such. In yet another embodiment, shown in FIGS. 5–7 are sequential, cross-sectional views illustrating a pumping stroke of a pilot-assisted air motor. The air motor has a drive shaft 111 for driving a conventional reciprocating piston pump (not shown) that is attached to a flange 119. The air motor has a housing 110 in which a reciprocating partition 112, preferably in the form of a piston, defines two pressure chambers 114, 116 in the housing on either side of the partition as the partition reciprocates therein. A motive gas conduit 118 is located through the partition thereby connecting the pressure chambers 114, 116 as the partition reciprocates. The motive gas conduit 118 may be provided as a through-hole located in the partition as shown such that, during the alternating pressurization and exhaust of the chambers that occurs during a pumping stroke, a portion of the gas filling the pressure chamber being pressurized is permitted to pass through the motive gas conduit to the pressure chamber being exhausted. In this fashion, by bleeding air to the exhausting chamber, the air temperature is raised to reduce icing in the exhausting chamber and the associated exhaust passageways.

Although described above with respect to use in conjunction with double diaphragm and reciprocating piston pumps, it is contemplated that the air motors according to the present invention may be incorporated into other pneumatic devices having a first pressure chamber and a second pressure chamber in which protection against icing is desired. According to the present invention, a method for reducing the ice formation in a gas-driven motor having first and second pressure chambers that are alternately pressurized with and exhausted of a motive gas is provided. The method includes the steps of providing the first pressure chamber with motive gas, exhausting the second pressure chamber of motive gas, and providing a portion of the motive gas from the first pressure chamber to the second chamber. The method according to the present invention permits the temperature of the air in the chamber to be maintained at a significantly warmer level thereby minimizing ice formation on exhaust.

While embodiments and applications of this invention have been shown and described, it will be apparent to those skilled in the art that many more modifications are possible without departing from the inventive concepts herein described. It is understood, therefore, that the invention is capable of modification and therefore is not to be limited to the precise details set forth. Rather, various modifications may be made in the details within the scope and range of equivalents of the claims without departing from the spirit of the invention.

What is claimed is:

1. A reduced-icing, gas-driven motor comprising:

a housing having a first pressure chamber and a second pressure chamber;

at least one partition disposed in the housing and being reciprocally moveable therein responsive to a motive gas being alternately provided to and exhausted from the first and second pressure chambers; and a motive gas conduit disposed between and connecting the pressure chambers such that, upon providing the first pressure chamber with motive gas and exhausting the second pressure chamber of motive gas, a portion of the motive gas is permitted to pass from the first pressure chamber to the second pressure chamber through the motive gas conduit.

2. The reduced-icing, gas-driven motor according to claim 1, further comprising a variable restriction in the motive gas conduit.

3. The reduced-icing, gas-driven motor according to claim 2, wherein the variable restriction is selected from the group consisting of a needle valve, a solenoid valve, and a pneumatic valve.

4. The reduced-icing, gas-driven motor according to claim 1, further comprising a fixed restriction in the motive gas conduit.

5. The reduced-icing, gas-driven motor according to claim 4, wherein the fixed restriction is a portion of the motive gas conduit having a decreased cross section.

6. The reduced-icing, gas-driven motor according to claim 1, wherein the at least one partition comprises a first partition and a second partition connected by a connecting rod, the first partition being disposed in the first pressure chamber and the second partition being disposed in the second pressure chamber.

7. The reduced-icing, gas-driven motor according to claim 6, wherein the first pressure chamber and the second pressure chamber are separate chambers connected by the motive gas conduit.

8. The reduced-icing, gas-driven motor according to claim 7, wherein the motive gas conduit connecting the first and the second pressure chambers is selected from the group consisting of a bore located in the housing and a tubular member connecting portions of the housing defining the pressure chambers.

9. The reduced-icing, gas-driven motor according to claim 6, wherein the first and second partitions are diaphragms.

10. The reduced-icing, gas-driven motor according to claim 1, wherein the at least one partition defines the first and second pressure chambers in the housing as the partition reciprocates therein, and the motive gas conduit is a through-hole located through the partition that connects the first and second gas chambers as the partition reciprocates.

11. The reduced-icing, gas-driven motor according to claim 10, wherein the partition is a piston.

12. A reduced-icing diaphragm pump comprising:

a first housing cavity having a first pump chamber and a first pressure chamber separated by a first pumping diaphragm; and a second housing cavity having a second pump chamber and a second pressure chamber separated by a second pumping diaphragm;

the first and second pumping diaphragms being movable respectively within the first and second pressure chambers responsive to a motive gas being alternately provided to and exhausted from the chambers; and a motive gas conduit disposed between and connecting the pressure chambers such that, upon providing the first pressure chamber with motive gas and exhausting the second pressure chamber of motive gas, a portion of the motive gas is permitted to pass from the first pressure chamber to the second pressure chamber through the motive gas conduit.

13. The reduced-icing, diaphragm pump according to claim 12, further comprising a variable restriction in the motive gas conduit.

14. The reduced-icing, diaphragm pump according to claim 13, wherein the variable restriction is selected from the group consisting of a needle valve, a solenoid valve, and a pneumatic valve.

15. The reduced-icing, diaphragm pump according to claim 12, further comprising a fixed restriction in the motive gas conduit.

16. The reduced-icing, diaphragm pump according to claim 15, wherein the fixed restriction is a portion of the motive gas conduit having a decreased cross section.

17. A reduced-icing piston pump comprising:

a gas motor having a housing chamber and a reciprocating drive rod disposed therein;

a reciprocally moveable partition located in the housing chamber and attached to the drive rod, the partition defining a first pressure chamber and a second pressure chamber as the partition reciprocates within the housing chamber responsive to a motive gas being alternately provided to and exhausted from the chambers with a motive gas; and a motive gas conduit located through the partition to connect the first and second gas chambers as the partition reciprocates such that, upon providing the first pressure chamber with motive gas and exhausting the second pressure chamber of motive gas, a portion of the motive gas is permitted to pass from the first pressure chamber to the second pressure chamber through the motive gas conduit.

18. The reduced-icing, piston pump according to claim 17, wherein the motive gas conduit is a through-hole located in the partition.

19. The reduced-icing, piston pump according to claim 17, wherein the partition is a piston.

20. A method for reducing ice formation in a gas-driven motor having a first pressure chamber and a second pressure chamber that are alternately pressurized with and exhausted of a motive gas, comprising the steps of:

providing the first pressure chamber with motive gas, exhausting the second pressure chamber of motive gas, and providing a portion of the motive gas from the first pressure chamber to the second chamber.

* * * * *